US007708364B2

(12) United States Patent
Mori et al.

(10) Patent No.: US 7,708,364 B2
(45) Date of Patent: May 4, 2010

(54) INK-JET RECORDING APPARATUS AND DATA TRANSFER APPARATUS

(75) Inventors: Masakazu Mori, Sagamihara (JP); Hiroaki Arakawa, Uenohara (JP); Tetsuo Uno, Tokyo (JP)

(73) Assignee: Konica Minolta Holdings, Inc. (JP)

( * ) Notice: Subject to any disclaimer, the term of this patent is extended or adjusted under 35 U.S.C. 154(b) by 385 days.

(21) Appl. No.: 11/809,490

(22) Filed: Jun. 1, 2007

(65) Prior Publication Data

US 2007/0279449 A1 Dec. 6, 2007

(30) Foreign Application Priority Data

Jun. 5, 2006 (JP) ..... 2006-155935

(51) Int. Cl.
*B41J 29/38* (2006.01)

(52) U.S. Cl. ..... 347/10; 347/14

(58) Field of Classification Search ..... 347/10
See application file for complete search history.

(56) References Cited

U.S. PATENT DOCUMENTS 5,825,375 A 10/1998 Droit et al.
5,833,375 A 11/1998 Gauthier et al.
6,145,946 A 11/2000 Gauthier et al.
6,299,271 B1 * 10/2001 Imai ..... 347/9
2006/0139434 A1 * 6/2006 Kurose et al. ..... 347/183

FOREIGN PATENT DOCUMENTS

JP 2002-67290 3/2002

OTHER PUBLICATIONS

European Search Report for Application No./Patent No. 07252183.4—1251 / 1864813 mailed Jun. 24, 2009.

* cited by examiner

*Primary Examiner*—Matthew Luu
*Assistant Examiner*—Brian J Goldberg
(74) *Attorney, Agent, or Firm*—Cantor Colburn LLP

(57) ABSTRACT

An ink-jet recording apparatus, including plural ink-jet head units which are daisy-chain-connected to a control section and eject ink; and the control section which sends serial driving data to the plural ink-jet head units, wherein each ink-jet head unit includes a head drive control section, which includes: a serial/parallel conversion section which converts the serial driving data inputted from a pre-ceding ink-jet head unit to parallel driving data, and sends the parallel driving data to a post-ceding ink-jet head unit; an identification information setting section which sets identification information for selecting a signal essential to drive the ink-jet head unit, a data extracting section which selects the signal essential to drive the ink-jet head unit, based on identification information, and a data processing section which conducts process for driving the ink-jet head unit, by the signal essential to drive the ink-jet head unit selected by the data extracting section.

8 Claims, 6 Drawing Sheets

INK-JET RECORDING APPARATUS AND DATA TRANSFER APPARATUS

This application is based on Japanese Patent Application No. 2006-155935 filed on Jun. 5, 2006, with the Japanese Patent Office, the entire content of which is hereby incorporated by reference.

TECHNICAL FIELD

The present invention relates to an ink-jet recording apparatus, and in particular, to an ink-jet recording apparatus which transfers data between daisy-chain-connected sections.

BACKGROUND OF THE INVENTION

For example, in an apparatus incorporating plural recording head units, such as an ink-jet recording apparatus, as shown in FIG. 5, driving data for jetting ink is sent as serial data or parallel data, from image developing circuit board 101, serving as a host, to head driving circuits (which are slave circuits 102) of each recording head. In this structure, when the number of recording head units increases, the number of connectors is also increased, to connect image developing circuit 101 and slave circuit 102, which results in the increase of transmission lines. Due to this, the scale of the circuit, and the size of the circuit board increase, leading to increased cost.

In recent years, as shown in FIG. 6, a technology is developed in which "n" pieces of recording element circuit boards and head pads, for connecting these recording heads each other and for connecting a printer to these recording element circuit boards, are daisy-chain-connected, which is disclosed in Unexamined Japanese Patent Application Publication No. 2002-67290. In FIG. 6, concerning heater power supply VH, GND, as well as Latch signal and CLK signal, since the same ones are to be applied onto each "n" pieces of recording element circuits, they are branched in a flexible wiring circuit board from a single head pad, and applied onto each recording element circuit board. The head pads are not illustrated in FIG. 6. On the other hand, DATA being an image data, and Heat signal for defining a conducting time of the heater are applied onto each recording element circuit board respectively, because recording image formation and optimum driving operation is conducted for each recording element circuit board. In order to apply different signals onto each recording element circuit board, two head pads 201 and 202 are provided on each recording element circuit board. Temperature sensor output terminal 124 and memory (which is a element characteristic) output terminal 123 are daisy-chain-connected to temperature sensor input terminal 122 and memory input terminal 121, of each adjoining recording element circuit board, respectively by flexible wirings. Further, concerning a recording element circuit board which has no adjoining recording element circuit board, which is an up-front recording element circuit board, its temperature sensor input terminal 122 and memory input terminal 121 are connected to VSS, and wirings are led out from temperature sensor output terminal 124 and memory output terminal 123 of a lattermost recording element circuit board, and which are connected to two head pads 210 of Memory Out and Temp. Out.

However, as shown in FIG. 6, while recording heads are daisy-chain-connected, the data element characteristic and the temperature sensor output are transferred through a shift register. Due to this, large delay is occurred for transferring them to the latter recording heads, and it is very difficult to transfer them in a real time. Further, since the image data is also transferred through a shift register by the same method as above, the delay occurs, and operation must wait until the data is completely transferred to each recording head. Therefore, it is very difficult to conduct the real time control, and the recording apparatus cannot operate at high speed.

SUMMARY OF THE INVENTION

An object of the present invention is to prevent generation of such defects, and to transfer information as soon as possible by daisy chain connection.

According to one embodiment of the present invention, in an ink-jet recording apparatus which includes a head drive control section to input a driving data essential to drive an ink-jet head unit, having been converted to a serial data, into an ink-jet head unit, and which outputs the serial data to a post-ceding device through the head drive control section, wherein the head drive control section includes a serial/parallel conversion section which converts the serial data, inputted from a pre-ceding device, to a parallel data, an identification information setting section which sets identification information for selecting and obtaining the signal essential to drive the ink-jet head unit, a data extracting section which selects and obtains the signal essential to drive the ink-jet head unit from the parallel data, based on said identification information set by the identification information setting section, and a data processing section which conducts process for driving the ink-jet head unit, by the signal essential to drive the ink-jet head unit selected and obtained by the data extracting section.

In regard to the effects of this invention, the serial data inputted from the pre-ceded device is directly outputted to the post-ceding device, and said serial data is simultaneously converted to parallel data by the serial/parallel conversion section, and the signal essential to drive the ink-jet head unit is selected and obtained from said parallel data, based on identification information, whereby the data processing section conducts the process for driving the ink-jet head unit. Accordingly, even when plural head drive control sections are daisy-chain-connected, each head driving section can obtain the data necessary for driving the ink-jet head unit, and simultaneously transfer the data to the head driving section without delay, therefore, high speed recording operation can be conducted. Further, the host section reads an area of serial data corresponding to each head drive control section, the data of each transfer device can be identified. Due to this, the daisy-chain connection with high speed transfer becomes possible, and malfunction is prevented.

DESCRIPTION OF THE PREFERRED EMBODIMENT

Figure 1:
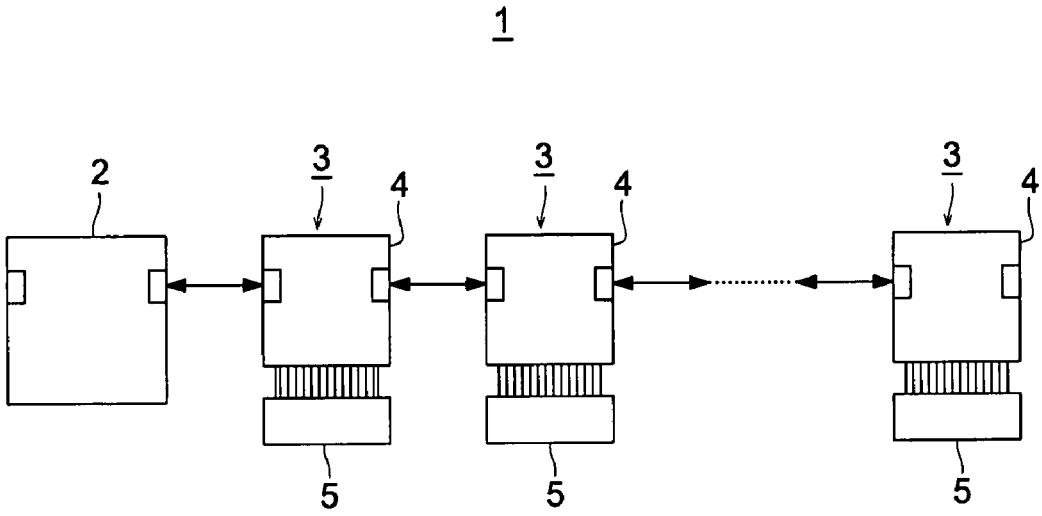
FIG. 1 is a drawing explaining a schematic structure of an ink-jet recording apparatus serving as a data transfer system relating to the present invention.

The ink-jet recording apparatus relating to the present embodiment will now be explained while referring to the drawings.

FIG. 1 is a drawing explaining a schematic structure of ink-jet recording apparatus 1. Ink-jet recording apparatus 1 is structured of:

control circuit board 2 which serves as the control section relating to the present invention, and connected to an image forming apparatus, such as a personal computer, and which receives image data and command data from said personal computer; and plural recording head units 3 which eject ink, based on the image data inputted from control circuit board 2. Plural recording head units 3 are daisy-chain-connected to control circuit board 2.

Control circuit board 2 converts the image data inputted from the image forming apparatus to data (being driving data) which is essential to drive the ink-jet head, and outputs the driving data to recording head unit 3. During the conversion, control circuit board 2 generates serial data as driving data which is driven by low voltage differential operation.

Recording head unit 3 is formed of head drive circuit board 4 serving as the head drive control section, relating to the present invention, to which the driving data is inputted from control circuit board 2, and also formed of head section 5 which ejects ink controlled by head drive circuit board 4. As described above, since plural recording head units 3 are daisy-chain-connected to control circuit board 2, plural drive circuit boards 4 are also daisy-chain-connected to control circuit board 2.

Embodiment 1

Figure 2:
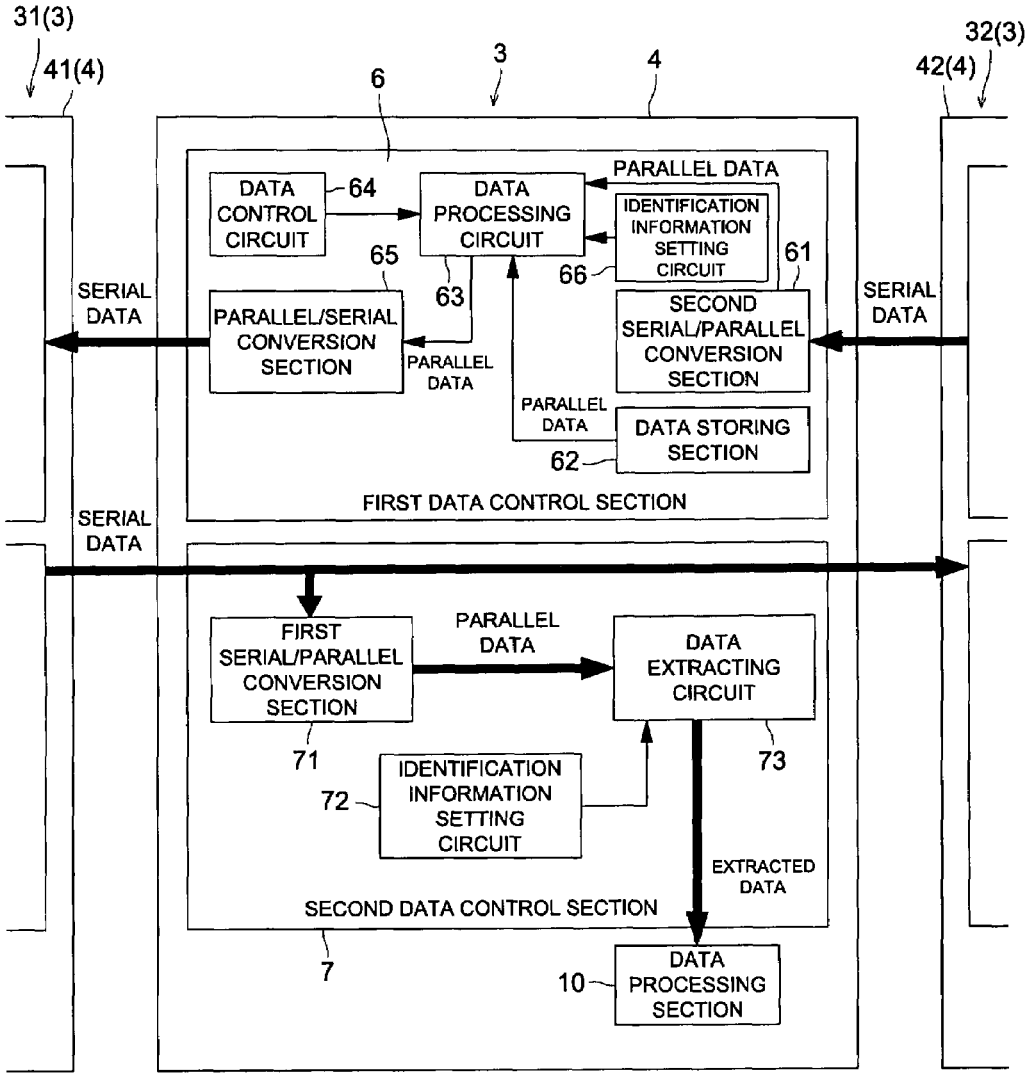
FIG. 2 shows a block diagram of a main control structure of a head driving circuit board of a recording head unit provided in the first embodiment of the ink-jet recording apparatus shown in FIG. 1.

FIG. 2 is a block diagram showing the main control structure of head drive circuit board 4 in embodiment 1. Head drive circuit board 4 includes first data control section 6 and second data control section 7. First data control section 6 receives serial data from head drive circuit board 42 of recording head unit 32 (which is a post-ceding device), which is connected to a device which is in an opposite direction to control circuit board 2, among daisy-chain-connected head drive circuit boards 4, and outputs it to head drive circuit board 41 of recording head unit 31 (which is a pre-ceding device), which is connected to control circuit board 2. Second data control section 7 receives the serial data from head driving circuit board 41, which is connected to control circuit board 2, and outputs it to head drive circuit board 42 which is connected to a device which is in an opposite direction to control circuit board 2.

First data control section 6 includes:

second parallel/serial conversion section 61 which converts the serial data, inputted from head drive circuit board 42 of recording head unit 32, being a post-ceding device, to parallel data;

data storing section 62, which stores an attaching data;

data processing circuit 63, which attaches the data in data storing section 62 to the parallel data converted by second serial/parallel conversion section 61;

data control circuit 64, which controls data processing circuit 63; and parallel/serial conversion section 65, which converts the parallel data carrying the data attached by data processing circuit 63, to serial data, and outputs said serial data to head drive circuit 41 of recording head unit 31, being a pre-ceding device.

The data, which is attached by data processing circuit 63, is response information relating to the present invention, which includes, print trigger signals, such as a print start signal, sensor signals, and a status signal which shows the condition of head drive circuit board 4. Further, when data control circuit 64 attaches the data to the parallel data converted by second serial/parallel conversion section, data control section 64 controls data processing circuit 63 to attach the data, after the area for attaching the data is selected, based on identification information of said recording head unit 3. Said identification information is, for example, represented by a circuit plate number which is assigned to each circuit board, and which is set by identification information setting circuit 66 provided on head driving circuit board 4 data processing circuit.

Figure 3:
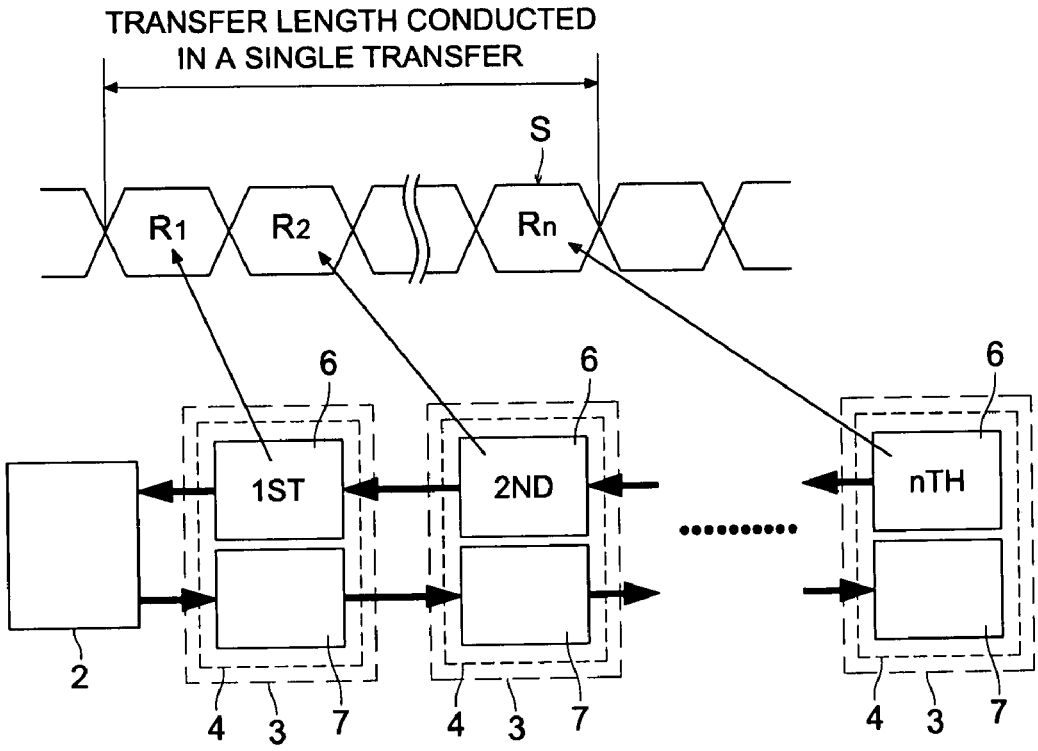
FIG. 3 shows the relationship between serial data and each recording head in the ink-jet recording apparatus shown in FIG. 1.

The serial data includes plural areas, each of which stores data for daisy-chain-connected recording head units 3 respectively, so as to correspond to each recording head unit 3. FIG. 3 shows the relationship between the serial data and each recording head unit 3. In FIG. 3, since the transfer length conducted in a single transfer of serial data S is divided into the total number of daisy-chain-connected recording head units 3, each recording head unit 3 is paired to each area R. For example, recording head units 3 are represented by $1^{st}$, $2^{nd}$, $3^{rd}$, - - - $n^{th}$, from the nearest one to control circuit board 2, then first area $R_1$ of serial data S is paired to $1^{st}$ recording head unit 3, second area $R_2$ of serial data S is paired to $2^{nd}$ recording head unit 3, - - - and $n^{th}$ area $R_n$ of serial data S is paired to $n^{th}$ recording head unit 3. Further, referring to the circuit board number (which is identification information), which is set by the circuit board number setting circuit 66, head drive circuit board 4 discriminates the data area of the parallel data which corresponds to said recording head unit 3, and allows said data area to be the area on which the data will be applied.

Second serial/parallel conversion section 61 stores each area of the inputted serial data sequentially, after which it converts the serial data to parallel data. That is, after the serial/parallel conversion, the parallel data includes the parallel data to equal to the total number of recording head units 3.

After data processing circuit 63 attaches the data to the parallel data corresponding to said device, it outputs the parallel data carrying the attached to second parallel/serial conversion section 65.

Parallel/serial conversion section 65 converts the parallel data to serial data to store each serial data into the corresponding area, and outputs the serial data into head driving circuit board 41 of recording head unit 31, being a pre-ceding device. Since parallel/serial conversion section 65 converts the parallel data to serial data (which is represented by LVDS) which is low voltage differential driving signal, high speed data transmission can be realized. Further the forefront device among plural daisy-chain-connected devices discriminates the data area which corresponds to each of plural head drive circuit boards 4 respectively, while referring to the serial data inputted by parallel/serial conversion section 65, via daisy-chain-connected plural head drive circuit boards 4.

Second data control section 7, as shown in FIG. 2, directly outputs the serial driving data inputted by head driving circuit board 41 of recording head unit 3, being a pre-ceding device, to head driving circuit board 42 of recording head unit 3, being a post-ceding device, without converting said serial driving data to parallel. Further, second control section 7 includes first serial/parallel conversion section 71 which converts the serial driving data, inputted from head driving circuit board 41 of recording head unit 31, to parallel driving data, identification information setting circuit 72 which sets identification information for selecting and obtaining the signal essential to drive the head of recording head unit 3, and data extracting section 73 which selects and obtains the essential signal from the parallel, data based on said identification information set by identification information setting circuit 72.

Head drive circuit board 4 includes data processing section 10, which conducts a predetermined process onto the data selected by data extracting circuit 73 of second data control section 7, and selects obtains essential signals from among the parallel data converted by first serial/parallel conversion section 71, and controls head section 5 by conducting process for head driving operation.

The function of an embodiment of the present invention will now be detailed.

The conveyance of the data from the image forming apparatus to each recording head unit 3 will be detailed first. When the image data is inputted from the image forming apparatus, control circuit board 2 converts said image data to serial data of the low voltage differential operation as the driving data, and then outputs the serial data onto head drive circuit board 4 of $1^{st}$ recording head unit 3.

After said serial data is inputted, second data control section 7 outputs said serial data to head driving circuit board 42 of $2^{nd}$ recording head unit 32 which is a post-ceding device, and to first serial/parallel conversion section 71. First serial/parallel conversion section 71 of second data control section 7 converts the serial data to parallel data, and outputs the parallel data to extracting circuit 73.

Data extracting circuit 73 extracts a parallel data corresponding to recording head unit 3 from among the parallel data, based on identification information set by identification information setting circuit 72. Data processing section 10 conducts process onto the data extracted by data extracting circuit 73, and controls head section 5 to eject ink.

Concerning head drive circuit boards 4 after $2^{nd}$ recording head unit 3, the same process as recording head unit 3 of $1^{st}$ recording head unit 3 is conducted.

In addition, on head drive circuit board 4 of $1^{st}$ recording head unit 3, the post-ceding device relating to the present invention is head drive circuit board 4 of $2^{nd}$ recording head unit 3, while the pre-ceding device is control circuit board 2.

Further, on head drive circuit boards 4 after $2^{nd}$ recording head unit 3 (which means $n^{th}$ recording head unit 3), the post-ceding device relating to the present invention is head drive circuit board 4 of $(n+1)^{th}$ recording head unit 3, while the pre-ceding device is head drive circuit board 4 of $(n-1)^{th}$ recording head unit 3.

Next, conveyance of the data from each recording head unit 3 to the image forming apparatus will be detailed.

When data is to be sent, second serial/parallel conversion section 61 of first data control section 6 of each recording head unit 3 sequentially converts each area of the serial data inputted from recording head unit 3 which is a post-ceding device, to parallel data, and outputs it onto data processing circuit 63.

Data control circuit 64 controls data processing circuit 63 to identify the parallel data corresponding to the said device among all parallel data converted by second serial/parallel conversion section 61, and further controls data processing circuit 63 to attach the data in data storing section 62 onto the identified parallel data, and to output the parallel data carrying the attached data to serial/parallel conversion section 65. In this case, by using identification information, data processing circuit 63 recognizes the parallel data corresponding to said recording head unit 3, and applies the data to the recognized parallel data.

Parallel/serial conversion section 65 sequentially converts the parallel data to serial data, so as to store the parallel data carrying the attached data in the area corresponding to said device, after which parallel/serial conversion section 65 outputs the serial data onto head drive circuit board 4 of recording head unit 3, being a pre-ceding device.

Since these operations are repeated in head drive circuit 4 of each recording head unit 3, the data corresponding to each area Rn of the serial data is attached to all the serial data. When the serial data, carrying the data attached by each recording head unit 3, enters control circuit 2, control circuit 2 conducts various processes via instruction, such as the input commands and firmware, based on the data attached on each area of the serial data.

As described above, the serial data inputted from the pre-ceding device is directly outputted to the post-ceding device, and the serial data is simultaneously converted to parallel data, after which the data processing section selects to obtain the essential signal among the converted parallel data, based on identification information, and conducts the process for driving the head units. Accordingly, though the plural head drive control sections are daisy-chain-connected, each head driving section can obtain the data essential to drive the head unit, and transfer the data to each head driving section without delay, therefore, the recording operation is conducted at high speed. Further, since the host section reads the area of the serial data corresponding to each head drive control section, the host section can recognize the data for each transfer device. Due to this, the daisy-chain connection with high speed data transfer becomes possible, and malfunction is prevented.

Still further, after each area of the serial data inputted from the post-ceding device is individually converted to be parallel data, the parallel data is then converted to serial data to be outputted to the pre-ceding device, and the parallel data is stored in the corresponding area. Accordingly, even when the plural transfer devices (which is recording head unit 3) have been daisy-chain-connected, the host section (which is control circuit board 2) reads the area of the serial data corresponding to each transfer device, the host section can recognize the data for each transfer device. Due to this, the daisy-chain connection with high speed data transfer becomes possible, and malfunction is prevented.

Specifically, after the data is attached to the parallel data by the transfer device, the parallel data is converted to serial data, to store the parallel data in the corresponding area, and said serial data is outputted to the pre-ceding device. Accordingly, each head unit 3 does not wait a turn sending own data, and stores the data in the area corresponding to the serial data, to send the data. Due to this, the daisy-chain connection in the present invention can transfer the data at high speed, and malfunction is prevented.

Further, when first data control section 6 attaches the data to the parallel data, it also simultaneously attaches the identification information of said section, whereby control circuit board 2 reads the attached data and identification information, and it can recognize to which section the data was attached as the parallel data.

The above descriptions in present embodiment can be appropriately changed within the scope of this invention as long as it does not deviate from the contents of the present invention.

For example, in the present embodiment, second data control section 7 selects the data corresponding to a specific recording head unit 3, among the serial data which is the driving data sent from control circuit board 2. Otherwise, if a data extracting circuit is provided on first data control section 6, data selection can be conducted by first data control section 6. In this case, second parallel/serial conversion section 65 of first data control section 6 converts the voltage level of the serial data inputted from control circuit 2 side, namely the pre-ceding device, and converts said serial data to parallel data. Further, in this case, second serial/parallel conversion section 61 returns to the voltage level of the serial data converted by second parallel/serial conversion section 65, and outputs it to the post-ceding device. Still further, the data extracting circuit selects the data corresponding to the said section from among the parallel data converted by second parallel/serial conversion section 65, and outputs the selected data to data processing section 10.

Still further, in the present embodiment, a mechanical switch is used for the identification information setting means. Other than that, an identification information setting signal outputted from a CPU, which would control head drive circuit board 4, can be used for the identification information setting means. Still further, concerning a setting method of identification information, for example, since the serial data, inputted from another device, previously includes identification information, identification information setting circuit 66 reads out identification information which corresponds to head driving circuit board 4 on which identification information setting circuit 66 is mounted, from said serial data, whereby identification information setting circuit 66 sets said identification information as identification information of said identification information setting circuit 66. In addition, data processing section 10 can rewrite or change identification information.

In the present embodiment which is a first embodiment, second data control section 7 directly outputs the driving data being the serial data, which is inputted from head driving circuit board 41 of recording head unit 31, being a pre-ceding device, onto head driving circuit board 42 of recording head unit 32, being a post-ceding device. However, in the present invention, instead of the first embodiment detailed above, it is also possible to use a second embodiment in which after the driving data is converted from the serial data to parallel data, said parallel data is converted to serial data, and the serial is outputted onto head driving circuit board 42 of recording head unit 32, being a post-ceding device.

Embodiment 2

Figure 4:
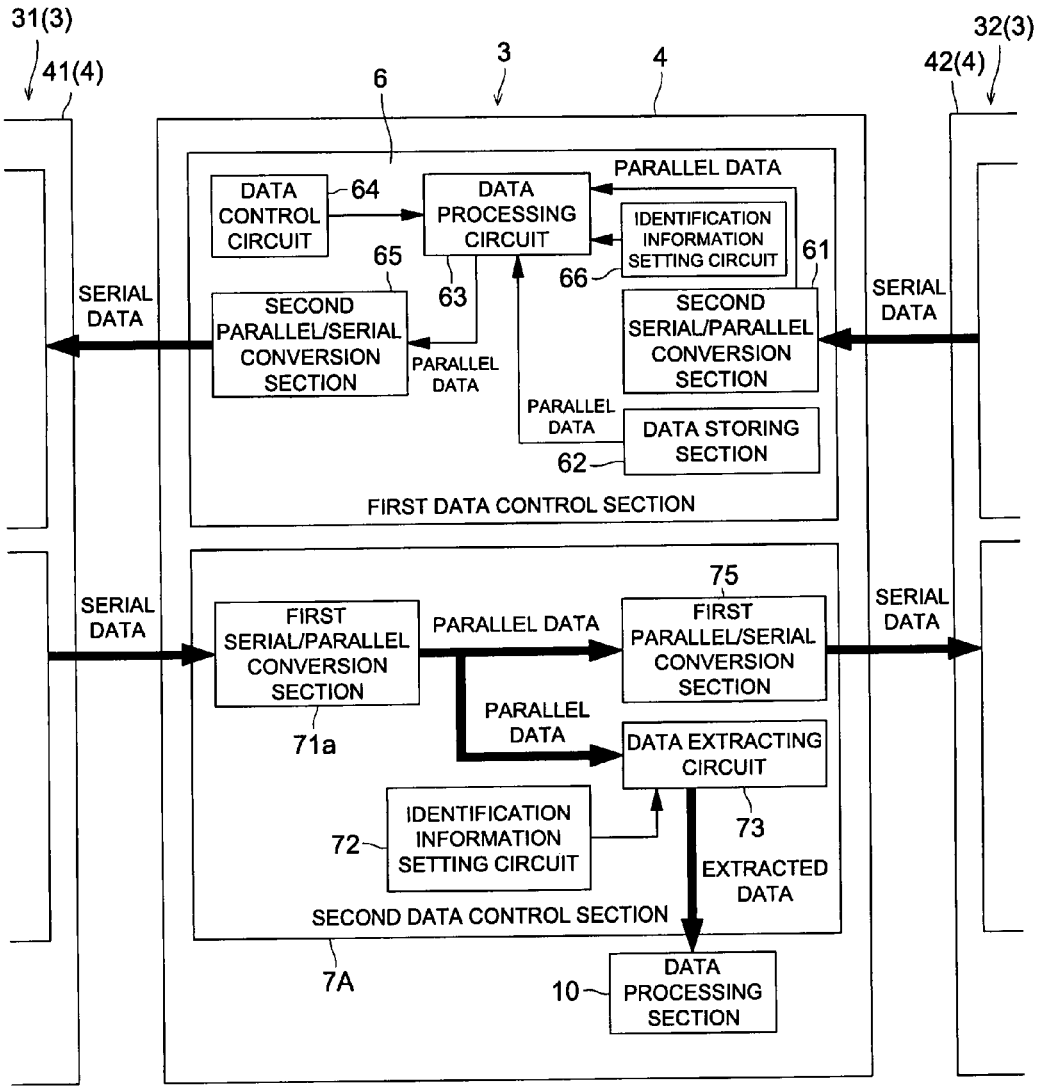
FIG. 4 is a block diagram of the head driving circuit board of the recording head unit as the second embodiment of the ink-jet recording apparatus of the present invention.
Figure 5:
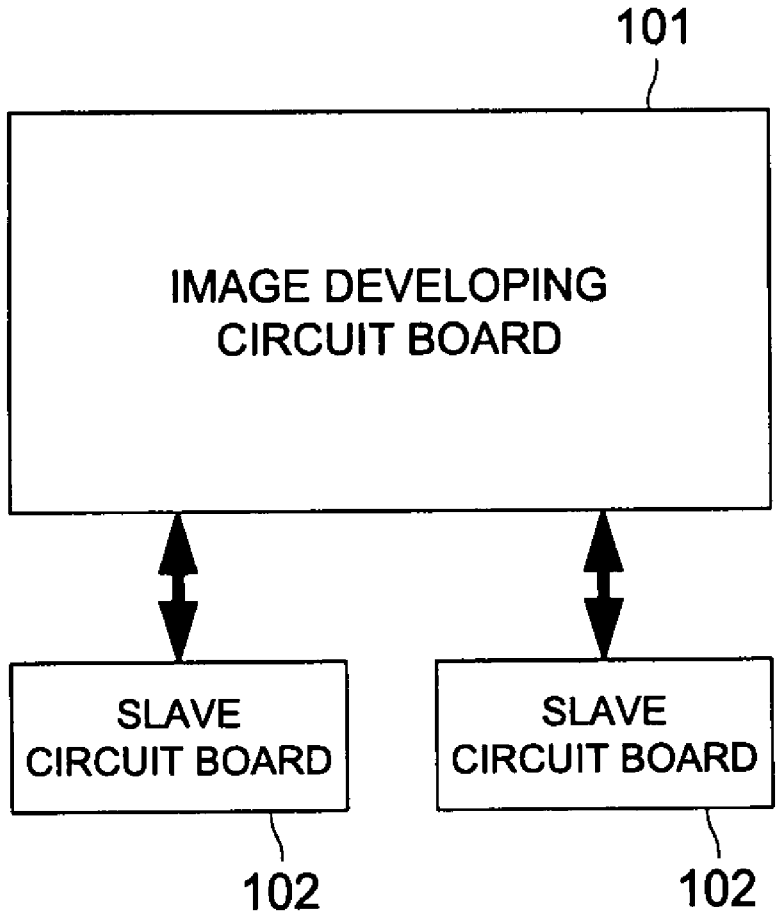
FIG. 5 CONVENTIONAL ART
FIG. 5 shows the schematic structure of a conventional ink-jet recording apparatus.
Figure 6:
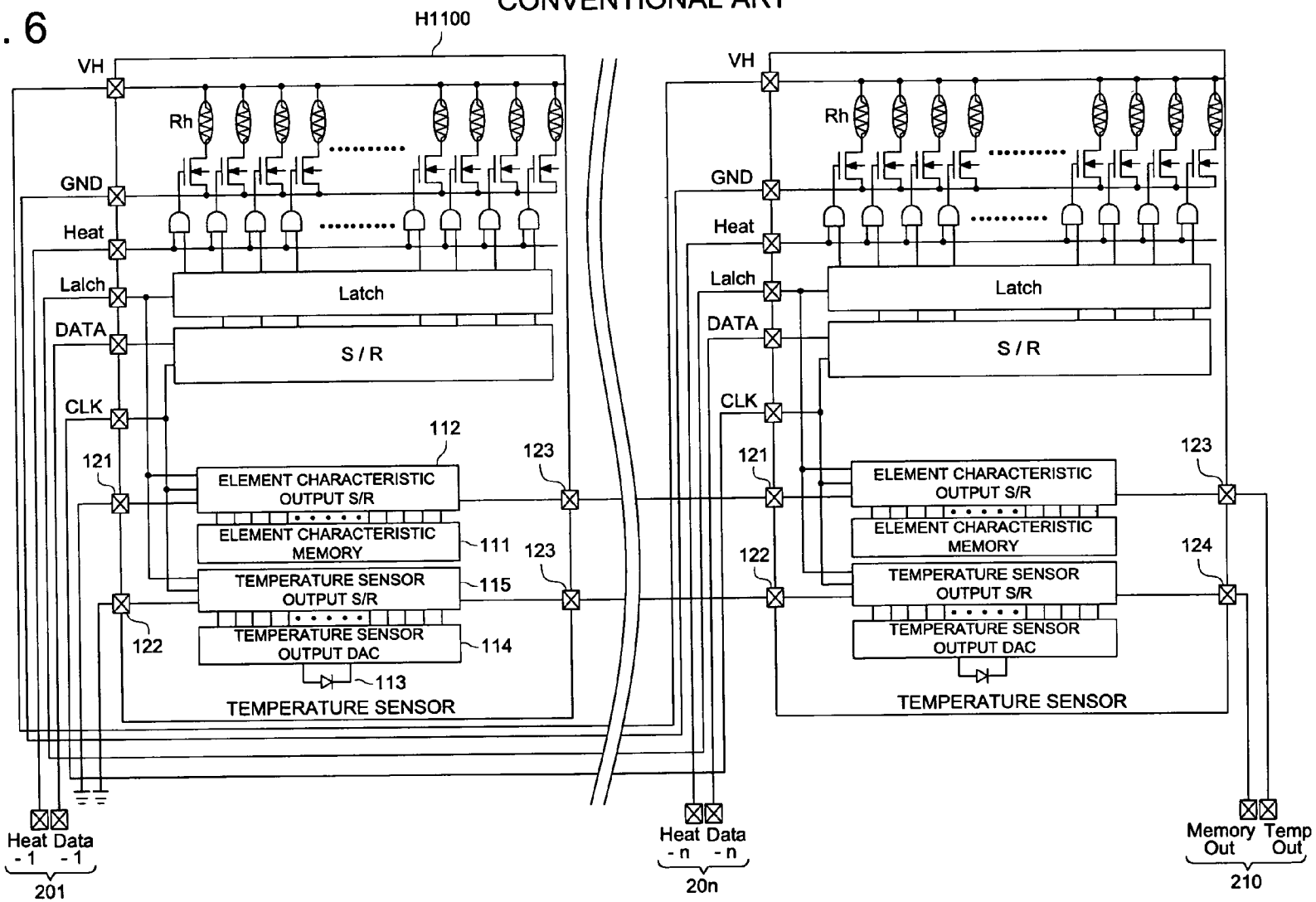
FIG. 6 CONVENTIONAL ART
FIG. 6 shows the schematic structure of a conventional ink-jet recording apparatus.

The second embodiment will be detailed while referring to FIG. 4. Sections in the second embodiment, serving as the same sections in the first embodiment, are represented by the same number as the sections in the first embodiment, and their explanations are omitted. In addition, though second parallel/serial conversion section 65 in FIG. 4 serves as the same parallel/serial conversion section 65 in FIG. 2, "second" is given to "parallel/serial conversion section 65" in FIG. 4, for the sake of convenience. In FIG. 4, second control section 7A includes: first serial/parallel conversion section 71*a* which converts the serial driving data, inputted from head driving circuit board 41 of recording head unit 31 being a pre-ceding device, to parallel driving data; identification information setting circuit 72 which sets identification information for selecting and obtaining the signal essential to drive the head of recording head unit 3; data extracting section 73 which selects and obtains the essential signal from the parallel data, based on said identification information set by identification information setting circuit 72; and first parallel/serial conversion section 75 which converts the parallel data, converted by first serial parallel conversion section 71*a*, to serial data, and which outputs said serial data to head driving circuit board 42 of recording head unit 32 being a post-ceding device.

After the serial data is inputted in second data control section 7A, first serial/parallel conversion section 71*a* converts the serial data to parallel data, and outputs the parallel data to data extracting circuit 73 and first parallel/serial conversion section 75.

Data extracting circuit 73 extracts parallel data corresponding to said recording head unit 3 among the parallel data, based on identification information which is set by identification information setting circuit 72. Data processing section 10 processes the data extracted by data extracting circuit 73, and controls head section 5 to eject ink.

First parallel/serial conversion section 75 converts the parallel data, which was inputted from first serial/parallel conversion section 71*a*, to serial data, and outputs the serial data to head driving circuit board 4 of second recording head unit 3.

In this manner, first serial/parallel conversion section 71*a* converts the serial data, inputted from another device, to parallel data, and data processing section 10 conducts a predetermine process on said converted parallel data. After which, the parallel data is converted to serial data by first parallel/serial conversion section 75, and outputted to other device. Referring to the process conducted by data processing section, the host section recognizes to which device each area of the serial data belongs, and even when plural head driving circuit sections are daisy-chain-connected, the host section reads the area of the serial data corresponding to each head driving circuit 4, whereby the data of each transfer device can be recognized. Accordingly, the data can be transferred by the daisy-chain connection at high speed, and malfunction is prevented.

What is claimed is:

1. An ink-jet recording apparatus, comprising plural ink-jet head units which are daisy-chain-connected to a control section and eject ink; and the control section which sends serial driving data to the plural ink-jet head units, wherein each ink-jet head unit includes a head drive control section, the head drive control section includes:

a serial/parallel conversion section which converts the serial driving data inputted from a pre-ceding ink-jet head unit to parallel driving data, and sends the parallel driving data to a post-ceding ink-jet head unit;

an identification information setting section which sets identification information for selecting a signal essential to drive the ink-jet head unit, a data extracting section which selects the signal essential to drive the ink-jet head unit, based on identification information, and a data processing section which conducts process for driving the ink-jet head unit, by the signal essential to drive the ink-jet head unit selected by the data extracting section.

2. The ink-jet recording apparatus of claim 1, wherein when the serial data enters the ink-jet head unit from the pre-ceding ink-jet head unit, the head drive control section inputs the serial data into the serial/parallel conversion section to convert the serial data to parallel data, and simultaneously sends the serial data to the post-ceding ink-jet head unit.

3. The ink-jet recording apparatus of claim 1, wherein the head drive control section further includes a parallel/serial conversion section which receives the parallel data sent from the pre-ceding ink-jet head unit as the serial data and converted to parallel data by the serial/parallel conversion section, and which converts the received parallel data to serial data, and outputs the serial data to the post-ceding ink-jet head unit.

4. The ink-jet recording apparatus of claim 1, wherein the head drive control section includes:

a second serial/parallel conversion section which converts serial data inputted from the post-ceding ink-jet head unit to parallel data; and a parallel/serial conversion section which attaches the identification information onto the parallel data converted by the second serial/parallel conversion section, and converts the parallel data carrying the attached identification information to serial data, and outputs the serial data to the pre-ceding ink-jet head unit.

5. The ink-jet recording apparatus of claim 1, including the plural head drive control sections which are daisy-chain-connected.

6. The ink-jet recording apparatus of claim 5, wherein an ink-jet head unit among the daisy-chain-connected ink-jet head units works as a host section of trailing daisy-chain-connected ink-jet head units in such a way that the host section discriminates a data area corresponding to each head drive control section from among the serial data inputted through the daisy chained plural head drive control sections, and the head drive control section allows the data area of the parallel data determined by the identification information which was set by the identification information setting section to be an area in which the identification information is added.

7. The ink-jet recording apparatus of claim 1, wherein the serial data is formed of low voltage differential signal.

8. The ink-jet recording apparatus of claim 1, wherein the serial data inputted from the pre-ceding ink-jet head unit includes the identification information, and wherein the identification information setting section reads out identification information, corresponding to the head drive control section which includes the identification information setting section, among the serial data, and sets the read-out identification information to be specific identification information of the identification information setting section.

* * * * *